US008833476B2

(12) United States Patent
Cordani

(10) Patent No.: US 8,833,476 B2
(45) Date of Patent: Sep. 16, 2014

(54) METHOD AND APPARATUS FOR EXTINGUISHING FIRES

(75) Inventor: Peter Cordani, Palm Beach Gardens, FL (US)

(73) Assignee: GelTech Solutions, Inc., Jupiter, FL (US)

( * ) Notice: Subject to any disclaimer, the term of this patent is extended or adjusted under 35 U.S.C. 154(b) by 450 days.

(21) Appl. No.: 13/291,449

(22) Filed: Nov. 8, 2011

(65) Prior Publication Data

US 2012/0193108 A1 Aug. 2, 2012

Related U.S. Application Data

(63) Continuation-in-part of application No. 12/887,230, filed on Sep. 21, 2010, now abandoned.

(51) Int. Cl.

| | |
|---|---|
| ***A62C 35/00*** | (2006.01) |
| ***A62C 15/00*** | (2006.01) |
| ***A62C 5/00*** | (2006.01) |
| ***A62C 3/16*** | (2006.01) |
| *A62C 17/00* | (2006.01) |
| *A62C 99/00* | (2010.01) |
| *A62C 3/02* | (2006.01) |

(52) U.S. Cl.

CPC ..... *A62C 5/002* (2013.01); *A62C 17/00* (2013.01); *A62C 15/00* (2013.01); *A62C 99/0009* (2013.01); *A62C 5/008* (2013.01); *A62C 3/16* (2013.01); *A62C 3/0221* (2013.01)

USPC ..... 169/14; 169/15

(58) Field of Classification Search

CPC ..... A62C 15/00; A62C 13/66; A62C 5/002; B05B 7/0869

USPC ..... 239/152, 154, 354, 337, 366; 169/14, 169/15, 18, 30

See application file for complete search history.

(56) References Cited

U.S. PATENT DOCUMENTS

| | | | |
|---|---|---|---|
| 3,583,490 | A | 6/1971 | McFadden |
| 4,330,040 | A | 5/1982 | Ence et al. |
| 4,384,988 | A | 5/1983 | Schoenholz et al. |
| 4,978,460 | A | 12/1990 | Von Blucher et al. |
| 5,087,513 | A | 2/1992 | Kim |
| 5,190,110 | A | 3/1993 | von Blucher et al. |
| 5,519,088 | A | 5/1996 | Itoh et al. |

(Continued)

FOREIGN PATENT DOCUMENTS

FR 2848865 6/2004

*Primary Examiner* — Davis Hwu

(74) *Attorney, Agent, or Firm* — McHale & Slavin, P.A.

(57) ABSTRACT

A unique method and apparatus for suppressing the spread of and extinguishing fires in confined areas such as underground tunnels and conduits. The new method includes mixing a super absorbent polymer supplied from a backpack, in one embodiment, with water to form a hydrated super absorbent polymer and applying this admixture to an electrical fire. The super absorbent polymer can be contained in a backpack. The admixture has the ability to cling to the object(s) to which it has been applied and either cool down the object(s) after it is on fire, or block the fire from reaching the object. The super absorbent polymer and water admixture also encapsulates the noxious and toxic gases and prevents the release of these toxic gases into the atmosphere. The super absorbent polymer and water admixture retains the ash, particulates, and other byproducts of the electrical fire to enable a rapid and thorough cleanup.

8 Claims, 8 Drawing Sheets

(56) References Cited

U.S. PATENT DOCUMENTS

| | | | | |
|---|---|---|---|---|
| 5,810,089 | A * | 9/1998 | Mack | 169/15 |
| 5,849,210 | A | 12/1998 | Pascente et al. | |
| 5,989,446 | A | 11/1999 | Hicks et al. | |
| 6,161,699 | A | 12/2000 | Gartland | |
| 6,167,971 | B1 | 1/2001 | Van Lingen | |
| 6,267,183 | B1 * | 7/2001 | Smagac | 169/30 |
| 6,371,384 | B1 | 4/2002 | Garcia | |
| 6,372,842 | B1 | 4/2002 | Grisso et al. | |
| 6,450,264 | B1 | 9/2002 | Christian | |
| 6,679,337 | B1 | 1/2004 | Perry et al. | |
| 6,834,728 | B2 | 12/2004 | Demole | |
| 6,841,125 | B1 | 1/2005 | Chartier et al. | |
| 6,929,072 | B2 | 8/2005 | Brown | |
| 6,945,468 | B1 | 9/2005 | Rodriguez et al. | |
| 7,096,965 | B2 | 8/2006 | Ozment | |
| 7,104,336 | B2 | 9/2006 | Ozment | |
| 7,124,834 | B2 | 10/2006 | Sundholm et al. | |
| 7,169,843 | B2 | 1/2007 | Smith et al. | |
| 2005/0150664 | A1 | 7/2005 | Miller et al. | |
| 2006/0157668 | A1 | 7/2006 | Erdner et al. | |
| 2008/0001007 | A1 * | 1/2008 | Gilpatrick et al. | 239/310 |
| 2008/0035354 | A1 | 2/2008 | Cordani | |
| 2009/0056957 | A1 | 3/2009 | Cordani | |

* cited by examiner

METHOD AND APPARATUS FOR EXTINGUISHING FIRES

CROSS-REFERENCE TO RELATED APPLICATIONS

This application is a continuation-in-part of U.S. patent application Ser. No. 12/887,230, filed Sep. 21, 2010, now abandoned entitled HOME SAFETY KIT; this application is also related to U.S. patent application Ser. No. 13/289,425, filed Nov. 4, 2011, entitled METHOD OF EXTINGUISHING UNDERGROUND ELECTRICAL FIRES, the entireties of both applications are incorporated herein by reference.

FIELD OF THE INVENTION

This invention relates to the field of fire prevention. More specifically, this invention describes a method of extinguishing and suppressing the rekindling of electrical fires in underground locations like underground utility conduits in cities.

BACKGROUND OF THE INVENTION

In many cities the utilities are located beneath the surface of the earth, usually beneath the surface of the streets. These utilities are usually placed in tunnels or conduits. In the older cities, such as New York City, these utilities have been located in these tunnels or conduits for many years/decades. Over time, the conduits which carry these utilities wear out and break. For example, water main breaks are a well known example of a utility conduit failing. Another serious problem is the failure of electrical transmission lines in conduits and tunnels. These failures usually result in fires which must be quickly extinguished to prevent further damage.

While it is desirable to replace very old utilities in conduits and tunnels, it is not always practical. Recently, a new tunnel for the supply of water was built under New York City. This was a tremendous project which took many years to complete and was very expensive. The replacement of the electrical transmission lines under the streets of New York City should also occur. However, due to financial restraints and other limitations, these transmission lines have not been replaced. Thus, these old electrical transmission lines break down or fail which results in electrical fires. These fires are commonly seen as smoke coming from manhole covers in the streets and sidewalks of a city. It has been estimated by Consolidated Edison that there are approximately 40 electrical fires per day in New York City.

The cost of repairing and replacing the electrical transmission lines damaged by these fires is approximately $100,000.00 per linear foot of transmission line. Therefore, it is imperative that these fires be extinguished as quickly as possible. Normally, when there is a fire, the firefighters locate the fire and call the utility to cut off the electrical power to that section of the electrical transmission line so that the fire can be extinguished with water. Because of the large voltage and current sent through these transmission lines, the application of water to these lines without the power being turned off would result in the instant electrocution of the firefighter. Accordingly, the firefighters wait until there is no doubt that all the electrical power has been turned off in the transmission lines they are about to extinguish. This, of course, results in the fire burning for an unnecessary extra amount of time and having the utility incur an unnecessary financial expense.

Once it has been established that the electrical power has been turned off, the firefighters enter the underground tunnel or conduit through a manhole and apply large amounts of water onto the electrical transmission lines which are on fire and/or smoldering until they determine that the fire has been completely extinguished and will not flare-up or restart. This large amount of water usually results in the destruction of good electrical transmission lines that are not involved in the fire. The water also fails to suppress the toxic gases produced by the burning electrical insulation, wires, and electrical components.

After the fire has been extinguished, a clean-up crew enters the tunnel or conduit to vacuum up the water, particulate ash from the burnt components and other residue created by the fire. This is a costly operation. Finally, after the clean-up crew has completed its job, a crew of electricians enters the tunnel or conduit to replace the electrical transmission lines and other equipment which has been destroyed/damaged with new equipment/components.

Structures are also susceptible to fire, some more than others. Fires can be caused from most any source but one of the most problematic fires is caused when a forest or other vegetation catches fire and a wind accompanies the fire. Such fires are a common occurrence and can easily be started by a lightning strike or the result of a human occurrence. In any event, as the general population continues to build structures in close proximity to large vegetative sources, more and more structures are placed at risk. Unfortunately the number of fire fighters to structures is not proportionate and is getting worse, not better.

Homes abutting a forest or other large vegetation areas are safe as long as the moisture content of the vegetation remains high. Should the vegetation become dry, the vegetation becomes fuel that can support a fire. For instance, while the Florida Everglades may be considered one of the most tropical areas in the United States, during a drought the everglades can catch fire and homes built near the everglades are susceptible to fire damage. Homes in Southern California may abut rugged areas filled with dead brush which can easily support the spread of a fire. Thousands of acres are consumed by fire each year and structure damages are increases as the population grows.

A raging fire can create its own environment with up-drafts and winds that can cause embers to carry to areas otherwise distant from the fire. Southern California is particularly susceptible to embers being carried when the Santa Anna winds occur. The result is that embers can be carried with the wind distributing potentially hazardous fire starters towards homes that would otherwise not be directly next to the forest or brush area. In many instances the homes include wood construction, such as wood shake shingles, which can easily catch fire should hot ember land upon the structure. If the owner of the structure is not in an evacuation zone, the owner may be an able bodied individual who can inhibit spreading of the fire to their structure by keeping high moisture content on the wood.

It is well known that the damage from many natural events can be reduced or eliminated with proper preparation. For instance, the owners of a structure may prepare for a hurricane at the last minute by installing window covers. Those in a fire zone may also be prepared to protect their structure but, unlike a hurricane, the path may be very small and the homeowner may have only a short notice that their structure is in harm's way. The danger of a fire is that while one structure may be located a distance from the fire, it may still catch fire while a structure closer to the fire does not catch fire. For these reasons, most homeowners attempt to protect their structure by using fire resistant products in the construction or repair of their buildings. In many instances the homeowners are not prepared for a fire due to lack of proper tools or funding to protect their structure when an actual fire is approaching. This lack of preparation places adjoining structures at risk.

The most commonly used item in protecting a structure is water. In fact, it is not uncommon to see a homeowner standing on their roof with a garden hose attempting to add moisture to the roof. Unfortunately, the quick evaporation of water due to low humidity and high temperatures can defeat the effort. Water has been known for its fire retardant and extinguishing properties and remains the predominate material used to extinguish or prevent certain types of fires. Water has a high heat capacity and high heat of vaporization, such that when water is sprayed onto a fire, the water that reaches the flames absorbs the heat of the fire and cools the article to below its combustion temperature. Water also deprives the fire of oxygen. Often the heat of the fire turns a portion of water into vapor before it can reach the flames. Since water vapor is heavier than air it displaces the oxygen surrounding the fire, thereby suffocating the fire.

A significant disadvantage often encountered using water to extinguish a fire is that much of it ends up wasted. Water applied directly to the fire mostly evaporates before it can reach the base of the fire, where the combustible fuel for the fire resides. As much as 90 to 95% of the water that does manage to reach the flames simply runs off into the ground. Moreover, considerable effort must be made to continuously soak objects with water near the fire that could ignite as the water evaporates very quickly. In order to maintain protection of the objects from fire the evaporated water must be constantly replaced.

Homeowners are very adept at protecting their homes if they are provided with access to the right materials. Those in a fire zone also attempt to protect their structures but need access to a variety of materials to treat a variety of conditions. For instance, a fire may be accompanied by a high wind that makes standing on a roof with a hose very dangerous. Should the fire turn toward the home the individual could be trapped on the roof. Should the winds pick up, the homeowner could slip on the now slickened roof, or the ladder used to access the roof could fall over.

The most exposed portion of any structure is typically the roof. For this reason a number of prior art devices are directed to the treating of a roof with water should a fire approach. For instance, U.S. Pat. No. 3,583,490 discloses a fire protection system for roofs. The system is for wetting the exterior surface of a building structure to prevent ignition of a fire in the vicinity of the structure. The protection system employs a recirculation water system directing water over both the roof and sidewalls of the structure and an automatic fire detection and control system for activating the water system in response to a fire and terminating operation of the water system when the fire is extinguished. A feature of this system is the collection of water from a rain gutter which is returned to a collection point, such as a swimming pool, for further distribution.

DESCRIPTION OF THE PRIOR ART

U.S. Pat. No. 6,834,728 discloses a system for extinguishing a fire in a tunnel. The system includes a conduit for delivering a fire extinguishing liquid and a trough extending parallel to the conduit for receiving liquid from the conduit. A carriage is arranged to move on a track which includes an upper edge of the trough. The carriage carries a pump having a nozzle, a video camera, and an inlet; each of which can be controlled robotically from a remote control station. The inlet is deployed in the trough to draw liquid from the trough.

U.S. Pat. No. 7,096,965 discloses a method of proportioning a foam concentrate into a non-flammable liquid to form a foam concentrate/liquid mixture and create a flowing stream of the foam concentrate/liquid mixture. Nitrogen is introduced into the stream of the foam/liquid mixture to initiate the formation of a nitrogen expanded foam fire suppressant. The flowing stream carrying the nitrogen expanded foam is dispensed, which completes the full expansion of the nitrogen expanded foam fire suppressant, into the confined area involved in the fire, thereby smothering the fire and substantially closing off contact between combustible material involved in the fire and the atmosphere. This substantially reduces the danger of explosion or flash fires. The apparatus of this invention is adapted for expanding and dispensing foam and includes a housing defining an interior through which extends a discharge line. The ends of the housing are closed about the ends of the discharge line, and the ends of the discharge line extend beyond the ends of the housing to define a connector at one end for receiving a stream of foam concentrate/liquid and at the opposite end to define the foam dispensing end of the apparatus. A portion of the discharge line in the housing defines an eductor for the introduction of expanded gas into the stream of foam concentrate/liquid flowing through the discharge line.

U.S. Pat. No. 7,104,336 discloses a method and apparatus for proportioning a foam concentrate into a non-flammable liquid to form a foam concentrate/liquid mixture and create a flowing stream of the foam concentrate/liquid mixture similar to the method and apparatus of U.S. Pat. No. 7,096,965. The present patent also includes an optional power generator which can be added to the system for instances where power is not readily available.

U.S. Pat. No. 7,124,834 discloses a method for extinguishing a fire in a space such as a tunnel. The method includes spraying a fire extinguishing medium into the space by spray heads. In a first stage of the method, the flow and temperature of the hot gases produced by the fire are influenced by spraying an extinguishing medium into the space, especially by creating in the space at least one curtain of extinguishing medium. At least some spray heads in the space are pre-activated into a state of readiness. In a second stage of the method, at least one spraying head is activated to produce a spray of extinguishing medium.

U.S. patent application Ser. No. 11/680,803 is entitled "Process for Fire Prevention and Extinguishing", the contents of which are incorporated herein by reference. In this application, a process for retarding or extinguishing conflagrations using a super absorbent polymer in water is disclosed. The reaction of the water with the polymer creates a gel-like substance with a viscosity that allows the mixture to be readily pumped through a standardized 2.5 gallon water based fire extinguisher, yet viscous enough to cover vertical and horizontal surfaces to act as a barrier to prevent fire from damaging such structures, minimizing the manpower needed to continuously soak these structures.

U.S. Pat. No. 7,169,843 discloses absorptive, cross-linked polymers which are based on partly neutralized, monoethylenically unsaturated monomers carrying acid groups, and with improved properties, which has a high gel bed permeability and high centrifuge retention capacity.

U.S. Pat. No. 5,989,446 discloses a water additive for use in fire extinguishing and prevention. The additive comprises a cross-linked water-swellable polymer in a water/oil emulsion. The polymer particles are dispersed in an oil emulsion wherein the polymer particles are contained within discrete water "droplets" within the oil. With the help of an emulsifier, the water "droplets" are dispersed relatively evenly throughout the water/oil emulsion. This allows the additive to be introduced to the water supply in a liquid form, such that it can be easily educted with standard firefighting equipment.

U.S. Pat. No. 5,190,110 discloses the fighting of fires or protection of objects from fire by applying water which comprises dispersing in the water particles of a cross-linked, water-insoluble, but highly water-swellable, acrylic acid derivative polymer in an amount insufficient to bring the viscosity above 100 mPa's. Advantageously, the particles are present in an amount such that, after swelling, the swollen particles hold 60 to 70% by weight of the total water; the polymer being a copolymer of an acrylic acid, the water containing silicic acid and/or a silicate as well as sodium, potassium or ammonium ions. The water is freely pumpable, but the swollen particles adhere to surfaces they contact rather than running off rapidly.

U.S. Pat. No. 5,849,210 discloses a method of preventing or retarding a combustible object from burning including the steps of mixing water with a super absorbent polymer ("SAP") to form one at least partially hydrated SAP, and applying the at least partially hydrated SAP to the combustible object, before or after combustion. In another embodiment, an article of manufacture includes a SAP that is prehydrated and is useful for preventing a combustible object from burning, or preventing penetration of extreme heat or fire to a firefighter or other animal.

U.S. Pat. No. 6,372,842 discloses methods of using an aqueous composition or dispersion containing a water-soluble or water-dispersible synthetic polymer, and compositions formed thereof. The aqueous composition or dispersion is added to agricultural spray, ink, deicing, latex paint, cleaner and fire-extinguishing chemical compositions, water-based hydraulic compositions, dust control compositions and so on, to impart properties including, but not limited to, aerosol control, shear stability, transfer efficiency, oil/water reduction, emollient performance, lubricity, thickening, and anti-wear capability, to the resultant composition formed thereof.

U.S. Pat. No. 5,087,513 discloses polybenzimidazole polymer/superabsorbent polymer particles. These articles are prepared by either mixing the super absorbent polymer particulates with the polybenzimidazole polymer solution during the formation of the polybenzimidazole article, or forming a composite of a polybenzimidazole film or fiber material layer with a super absorbent polymer particulate containing layer. These polybenzimidazole products absorb large amounts of fluid while retaining the flame retardancy and chemical unreactivity of conventional polybenzimidazole materials.

U.S. Pat. No. 4,978,460 discloses a particulate additive for water for fire fighting containing a strongly swelling water-insoluble high molecular weight polymer as gelatinizing agent, which comprises a water-soluble release agent which causes the particles of said gelatinizing agent not to swell, the particles of the gelatinizing agent being encased or dispersed in the release agent. Suitable release agents include polyethylene glycol, sugars, mannitol, etc. The gelatinizing agent may be a moderately cross-linked water-insoluble acrylic or methacrylic acid copolymer.

U.S. Pat. No. 5,519,088 discloses an aqueous gel comprising a polymer of (meth)acrylamide or particular (meth)acrylamide derivative(s), particulate metal oxide(s) and an aqueous medium, a process for producing said gel, and products utilizing said gel. This aqueous gel can be produced so as to have transparency, be highly elastic and fire resistant, and can prevent the spreading of flames. The aqueous gel when produced transparent, becomes cloudy when heated or cooled and is useful for the shielding of heat rays or cold radiation.

U.S. Pat. No. 4,330,040 discloses a fire prevention and cooling system including a main supply tube and a main dispensing tube for wetting a structure. The dispensing tube is U-shaped and is connected to the supply tube via a series of feed lines. The system includes elements to acquire water from alternative sources such as a pool or a tub and secondary tubes for wetting side walls.

U.S. Pat. No. 6,167,971 discloses a fire protection system for a building having a periphery with a roof situated thereon. The roof is supported by rafters which are angled downwardly from a ridge to an eave which extends beyond the periphery of the building a predetermined distance. Included are a water supply and a plurality of supply pipes connected at a first end thereof extending to the building such that the water may flow from the reservoir tank to the building. Also included is a plurality of above ground distribution pipes. The above ground distribution pipes include at least one vertical pipe situated on the periphery of the building with a lower end thereof connected to a second end of the underground pipe and a plurality of horizontal pipes connected to an upper end of the vertical pipe and extending along the length of the eave on an underside thereof. A plurality of sprinklers are connected to the horizontal pipes to spray water upwardly towards the rafters and downwardly towards the windows of the building. Finally, a pump is included which is adapted to affect the flow of the water from the reservoir tank through the pipes and to the sprinklers upon the receipt of an activation signal.

U.S. Pat. No. 6,450,264 discloses a sprinkler system for preventing brush and forest fires from engulfing a home. The sprinkler system includes a piping assembly being adapted to extend along a peak of a roof, the underside of eaves and along a fence line. It also includes a shield assembly including an elongate shield member being adapted to extend along the peak of the roof and shield support members being adapted to fasten to the roof of the building for supporting the elongate shield member; and further includes a water supply assembly being connected to the piping which includes a pump/control assembly.

U.S. Pat. No. 6,679,337 discloses a fire prevention system including a water sprinkler frame mounted on a house and having a plurality of sprayer nozzles. Also included is a water supply tank situated adjacent to the house and connected to the sprinkler frame with a pump coupled there between for supplying water to the water sprinkler frame upon the receipt of a heat signal. A plurality of temperature sensors mounted on the ground and spaced from a perimeter of the house or mounted to the top of the house are connected to the pump for transmitting the heat signal thereto upon the detection of a degree of heat greater than a predetermined amount.

U.S. Pat. No. 6,929,072 discloses a device and method for inhibiting the spread of a fire to the roof of a building by placing a base supporting a sprinkler and hose in fluid communication providing a source of water ejected from the sprinkler onto the roof. The interior of the base may be wetted to increase its weight. A rope, normally stored on a spool removably attached to the base, may be used to reposition the base on the roof.

U.S. Pat. No. 6,945,468 discloses a rainfall simulation apparatus for a structure, comprising a water source, an electric pump, a vertically oriented riser pipe, a perforated header pipe along the roof of the structure, a V-shaped aperture-containing trough connected to the roof, and an elongated collection bin below the trough and connected to the pump.

SUMMARY OF THE INVENTION

A unique method and apparatus for suppressing the spread of and extinguishing fires in confined areas such as underground tunnels and conduits is disclosed. The new method includes mixing a super absorbent polymer with water to form a hydrated super absorbent polymer and applying this admixture to a fire. The super absorbent polymer and water admixture has substantially superior fire suppression and extinguishing properties than the fire suppression and extinguishing properties of plain water. One of the unique properties of the admixture is its ability to cling to the object(s) to which it has been applied and either cool down the object(s) after it is on fire, or block the fire from reaching the object. These superior properties enable fires to be extinguished more rapidly and not flare back up. The super absorbent polymer and water admixture also encapsulates the noxious and toxic gases produced by fires, in particular electrical fires, and prevents the release of these toxic gases into the atmosphere. The super absorbent polymer and water admixture retains the ash, particulates, and other byproducts of the electrical fire to enable a rapid and thorough cleanup. Additionally, the admixture can also be used to fight convention structure fires, forest fires, brush fires, etc.

Accordingly, it is an objective of the present invention to provide a unique method of suppressing the spread of and extinguishing fires in confined areas.

It is a further objective of the present invention to provide a unique method of suppressing the spread of and extinguishing fires in underground tunnels and conduits.

It is yet another objective of the present invention to provide a unique method of suppressing the spread of and extinguishing fires which utilizes substantially less water, resulting in less damage to electrical components and other equipment located adjacent the fire.

It is still yet another objective of the present invention to provide a unique combination of super absorbent polymer, stored in a backpack worn by an individual, and water which has viscosity sufficient to enable it to adhere to horizontal, incline, and vertical surfaces.

It is still yet another objective of the present invention to provide a unique combination of super absorbent polymer and water which has viscosity sufficient to enable it to adhere to horizontal, incline, and vertical surfaces. Also, its viscosity enables it to cling to curved and non-planar surfaces.

It is a still further objective of the present invention to provide a unique method of suppressing the spread of and extinguishing fires which enables the fires to be extinguished more rapidly.

It is a still further objective of the present invention to provide a unique method of suppressing the spread of and extinguishing fires which prevents the escape of noxious and toxic gases into the atmosphere.

It is a still further objective of the present invention to provide a unique method of suppressing the spread of and extinguishing fires which results in a rapid and less expensive cleanup process.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
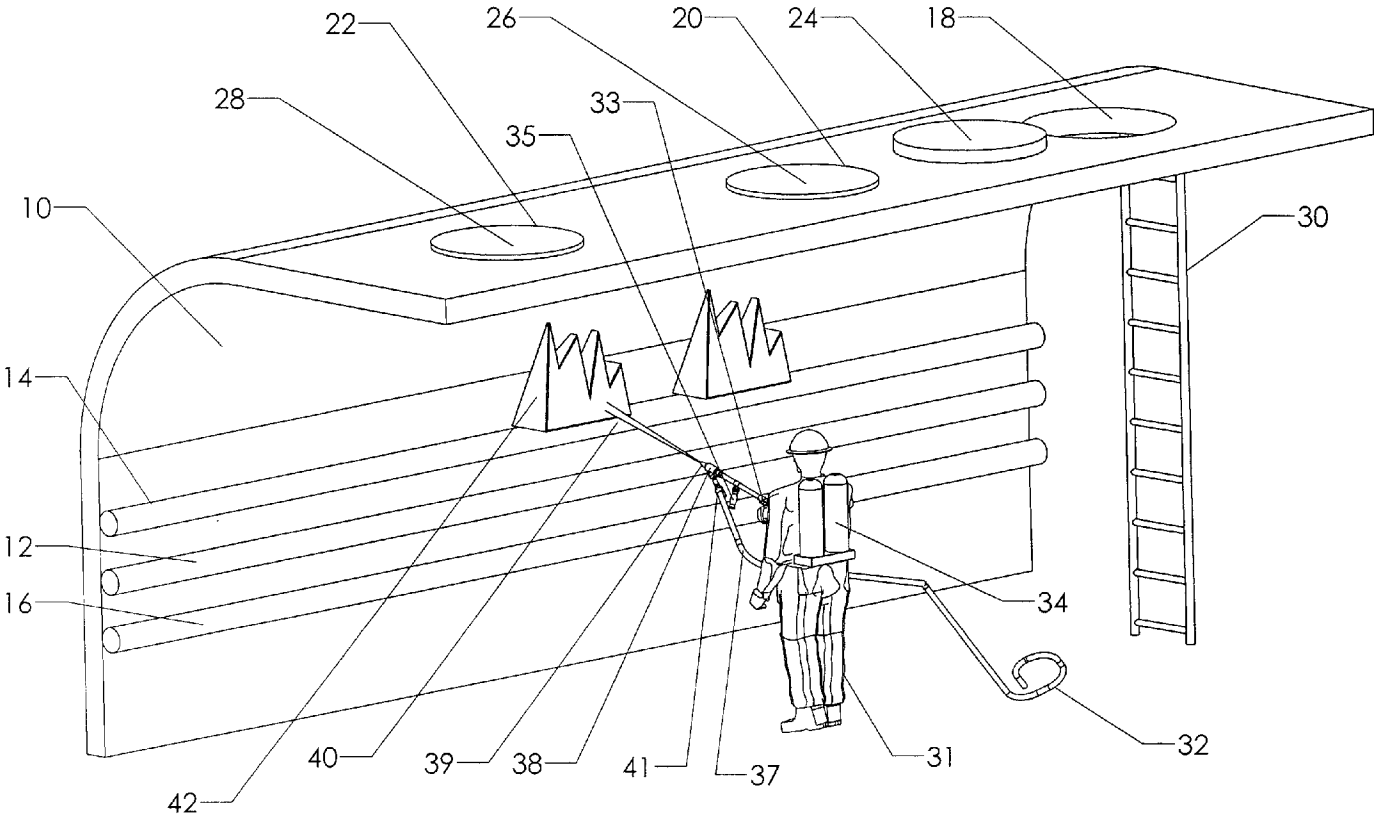
FIG. 1 is an illustration of the present invention being used to fight an electrical fire in an underground tunnel or conduit.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

The present invention relates to a unique technique or method of and apparatus for suppressing the spread of and extinguishing fires. This unique technique utilizes a super absorbent polymer in water in an amount sufficient to suppress the spread of and extinguish an electrical fire. The present invention utilizes biodegradable, super absorbent, aqueous based, polymers. Examples of these polymers are cross-linked modified polyacrylamides/potassium acrylate or polyacrylamides/sodium acrylate. Other suitable polymers include, albeit are not limited to, carboxy-methylcellulose, alginic acid, cross-linked starches, and cross-linked polyaminoacids.

Currently, the firefighters apply water to electrical conduits/components which are on fire and also to adjacent conduits/components because it is difficult to control the distribution of the water. This contact of water on electrical conduits/components that are not on fire results in substantial unnecessary damage to these conduits/components. The present invention, on the other hand, enables the firefighter to direct the super absorbent polymer water admixture to a specific electrical conduit/component. The admixture then adheres to that conduit/component without affecting adjacent conduits/components. Thus, a substantial financial savings is gained by the present invention because electrical conduits/components which are not on fire are not damaged by water. It has been estimated that in a large city, such as New York City, the cost of repairing/replacing damaged underground electrical conduits/components is approximately $100,000.00 per linear foot. Therefore, by avoiding applying the water on adjacent electrical components a substantial financial savings can be achieved.

Another disadvantage of using only water to fight electrical fires is that the water will not suppress the noxious and/or toxic gases produced by the burning electrical wires, insulation, and other components. However, the admixture of super absorbent polymer and water of the present invention has physical and chemical properties which enable the admixture of super absorbent polymer and water to entrap and retain the noxious and/or toxic gasses and prevent the release of these gases into the atmosphere. This is an important advantage that the present invention has over the prior art because it prevents the noxious and/or toxic gases from reaching and affecting the firefighters.

When there are fires in underground tunnels or conduits, the firefighters contact the electrical utility to have the electrical power turned off so they can fight the fire. In rare instances, the electrical power is not turned off which may result in serious injury and/or death of the firefighters when they apply water to the electrical fire. The present invention produces an admixture having properties such that the admixture will not readily flow or run from the object onto which the admixture has been applied. Therefore, even though the super absorbent polymer water admixture contains a large amount of water, if the admixture is applied to a live electrical wire or component, the electricity will not travel back to the firefighter because the water will remain on the object to which the admixture has been applied due to its physical properties and not travel to the firefighter.

Another advantage of the unique method of suppressing the spread of and extinguishing fires of the present invention is that the admixture of super absorbent polymer and water retains the ash and other by-products produced by the electrical fire. By entrapping and retaining the ash and other particulates of the fire in a contained mass, the cleanup is facilitated, thus making the cleanup easier and quicker than the cleanup when only water is used to fight the electrical fires. The mass of the admixture of super absorbent polymer, water, fire particulates, and residue can be readily cleaned up by vacuuming or other similar techniques. This also adds to the financial savings achieved by the unique method of the present invention.

FIGS. 1-12, which are now referenced, illustrate the present invention which relates to a new and unique method of suppressing the spread of and extinguishing electrical fires. Electrical fires present different and unique problems pertaining to how these fires should be suppressed and extinguished. Water is normally used to fight fires because is can quickly cool down the burning material and there is usually a large supply of it ready for use. However, water and electricity are harmful, if not deadly, when brought into contact with each other. Normally, when water hits an active electrical circuit or electrical component, it shorts out the circuit or component, which usually results in destruction of the circuit or component. Further, when individuals are in close proximity to the water contacting the electricity, there is a strong likelihood that the water will act as a conductor and conduct the electricity to the individuals, resulting in serious injury or death of the individuals. Since water spreads rapidly in all directions on surfaces, electricity which comes in contact with the water will be conducted to wherever the water flows. Because it is difficult to prevent water from flowing to certain areas, there is a strong likelihood that individuals will be injured or killed when they come in contact with this water.

In the preferred embodiment of the present invention, a solid form of the super absorbent polymer, such as a powder, is drawn into a water stream by use of an eductor at a rate which results in an aqueous admixture of the super absorbent polymer and water having properties which enable the super absorbent polymer/water mixture to be applied to and remain on vertical, horizontal, and curved surfaces of objects which are on fire or are capable of catching on fire. The present invention adds a predetermined amount of the super absorbent polymer to a predetermined amount of water to obtain an admixture which has properties that enable the admixture to suppress the spread of an electrical fire and extinguish the electrical fire. The preferred predetermined amounts are 5-8 pounds of dry solid super absorbent polymer to 100 gallons of water. The size of the dry solid super absorbent polymer is preferably less that 5 microns in diameter, and the most preferred size of the dry solid super absorbent polymer is 3 microns in diameter. In addition to being added to a stream of water, the super absorbent polymer can be added to a given volume of water and the resulting admixture pumped to a location to suppress the spread of and extinguish electrical fires. The adherence of the admixture of super absorbent polymer and water to the surface of an object lowers the temperature of the object below the combustion temperature of the object, thereby extinguishing the fire. In addition, adherence of the admixture of super absorbent polymer and water to the surface of an object maintains moisture content at a level which suppresses the spread of the fire by preventing combustion of the object from hot embers and/or flames. The ratio of super absorbent polymer to water can also be selected so that the admixture will form a pile or clump and not migrate or move from an area into which it has been placed.

Now referring to FIG. 1, an underground tunnel or conduit 10 has a plurality of utilities therein. These utilities can be electrical cables 12, telephone lines 14, water supply lines 16, etc. Access to these utilities is normally gained through at least one of the manholes 18, 20, and 22. Each of these manholes 18, 20, and 22 has a cover 24, 26, and 28 respectively which closes the manhole to prevent unauthorized access thereto. When the manhole cover is removed, access to the underground tunnel through the manhole is granted or enabled. Usually a ladder 30 or similar device is secured to a wall of the tunnel or conduit adjacent the manhole so that an individual can pass through the manhole and proceed down the ladder to the bottom of the tunnel or conduit. In some instances a portable ladder may be secured to the edge of the manhole and lowered into the tunnel to provide access for individuals into the tunnel.

Figure 12:
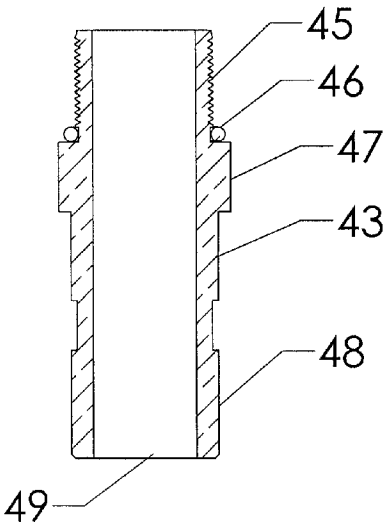
FIG. 12 is a cross sectional view of the adaptor of F*ig*. 13 taken along line 14-14.
Figure 11:
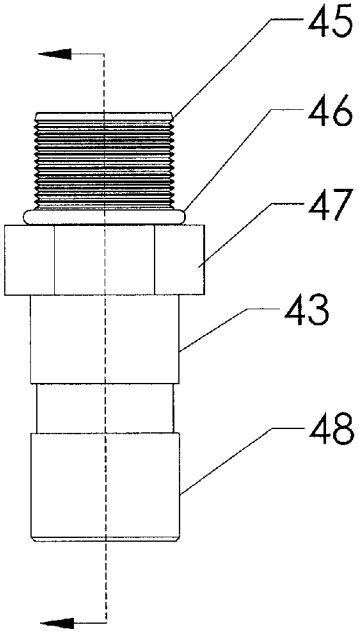
FIG. 11 is a side view of an adaptor.

A firefighter or other individual 31 enters the underground tunnel or conduit through a manhole with the instant invention to suppress the spread of and extinguish electrical fires (FIG. 1). A hose 32 is connected to a pressurized supply of water. A backpack or container 34 has a predetermined quantity of dry super absorbent polymer therein. A hose 36 is connected between the backpack 34 and a gun or wand 37. The gun 37, FIGS. 1 and 5-7, includes an eductor 38 which mixes the dry super absorbent polymer and pressurized water in the correct proportion to provide an admixture 40 of super absorbent polymer and water having the desired fire suppression and fire extinguishing properties. The gun 37 also includes a nozzle 39 secured to the outlet of the eductor 38. The nozzle 39 creates a stream of the admixture 40 which can travel a substantial distance and be selectively applied to electrical fires. An adaptor or flow restrictor 43 is secured between the eductor 38 and the barrel 44 of the gun 37, as illustrated in FIGS. 6, 8, 11 and 12. The adaptor 43 includes an end 45 which is threaded externally, an O-ring seal 46, a hexagonal portion 47 which is used to tighten the adaptor into the barrel 44, an internally threaded end 48, and a passage 49 therethrough for water or fluids (FIG. 12). After passing from the gun 37, the admixture 40 is applied to the electrical fire 42 to suppress the spread of and extinguish it. The admixture 40 of super absorbent polymer and water will also adhere to vertical, horizontal, and curved surfaces of objects to help prevent the objects from catching fire because of the moisture content of the mixture. The moisture content of the admixture is sufficient to prevent flames and/or embers from reaching the objects and igniting them.

The gun 37 has an on-off trigger or first valve 33 which controls the flow of water or fluid admitted to the gun 37 by turning it on and off. This trigger 33 controls the application of the admixture to the fire or the areas surrounding the fire. The trigger or first valve also controls the rate of water or fluid admitted to the gun 37. Valve 33 can also be adjustable to increase or decrease the rate of flow of water or fluid admitted to the gun 37. The gun also has a swivel handle 35. The handle 35 can optionally be a variable valve which controls the amount of water or fluid flowing to the eductor 38. The gun 37 also has a manually operated second valve 41 which permits the fireman or operator 31 to manually control the amount of solid super absorbent polymer being admitted to the eductor to be mixed with the water. The second valve 41 is preferably a ball valve. However, other types of valves can be employed which regulate the amount of super absorbent polymer or material which passes through the valve. Thus, different admixtures of super absorbent polymer and water are possible by use of second valve 41.

Figure 4:
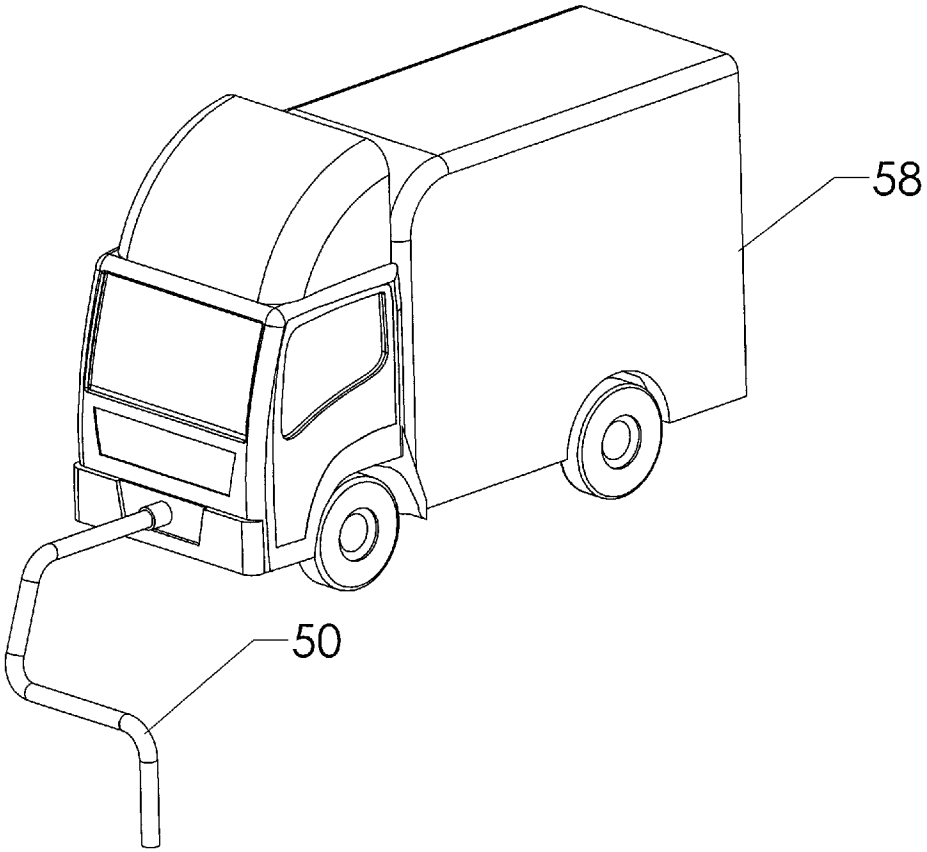
FIG. 4 is a truck/van normally used by a utility company.
Figure 7:
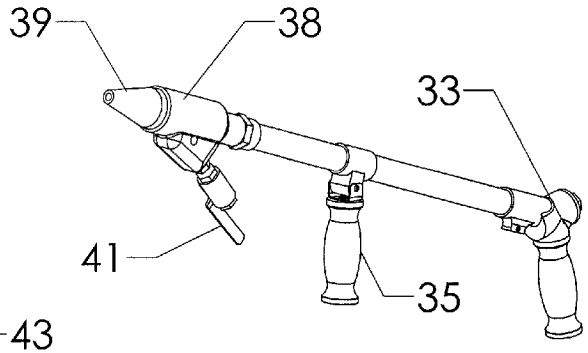
FIG. 7 is a front perspective view of the gun in FIG. 5.
Figure 6:
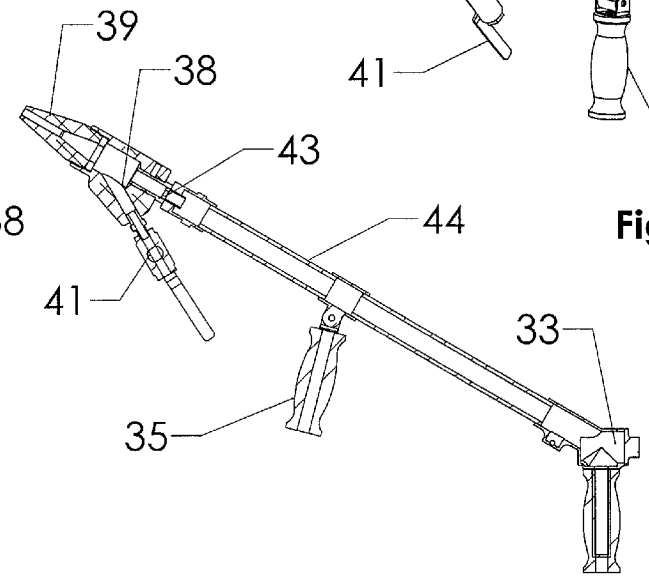
FIG. 6 is a cross sectional view of the gun taken along line A-A in FIG. 5.
Figure 5:
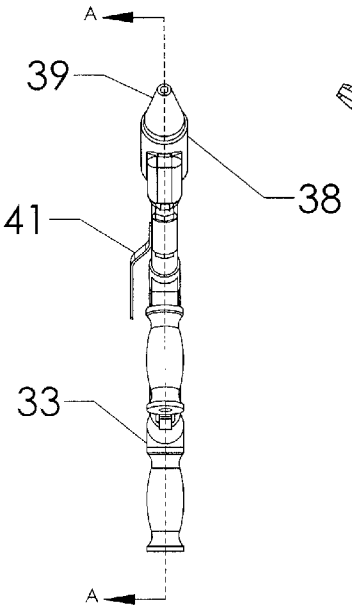
FIG. 5 is a front view of a gun or wand used to deliver the material to perform the method of the present invention.
Figure 9:
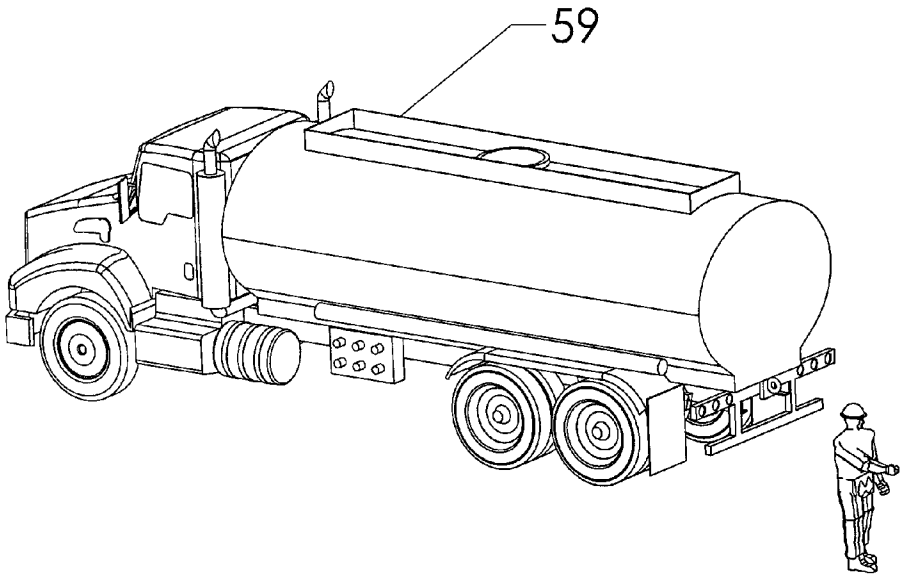
FIG. 9 is a perspective view of a truck used to transport the material to perform the method of the present invention.
Figure 8:
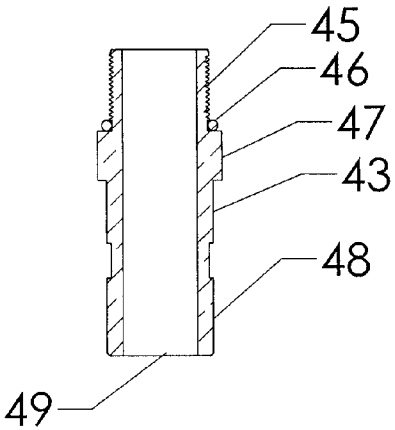
FIG. 8 is a cross section of an adaptor.
Figure 10:
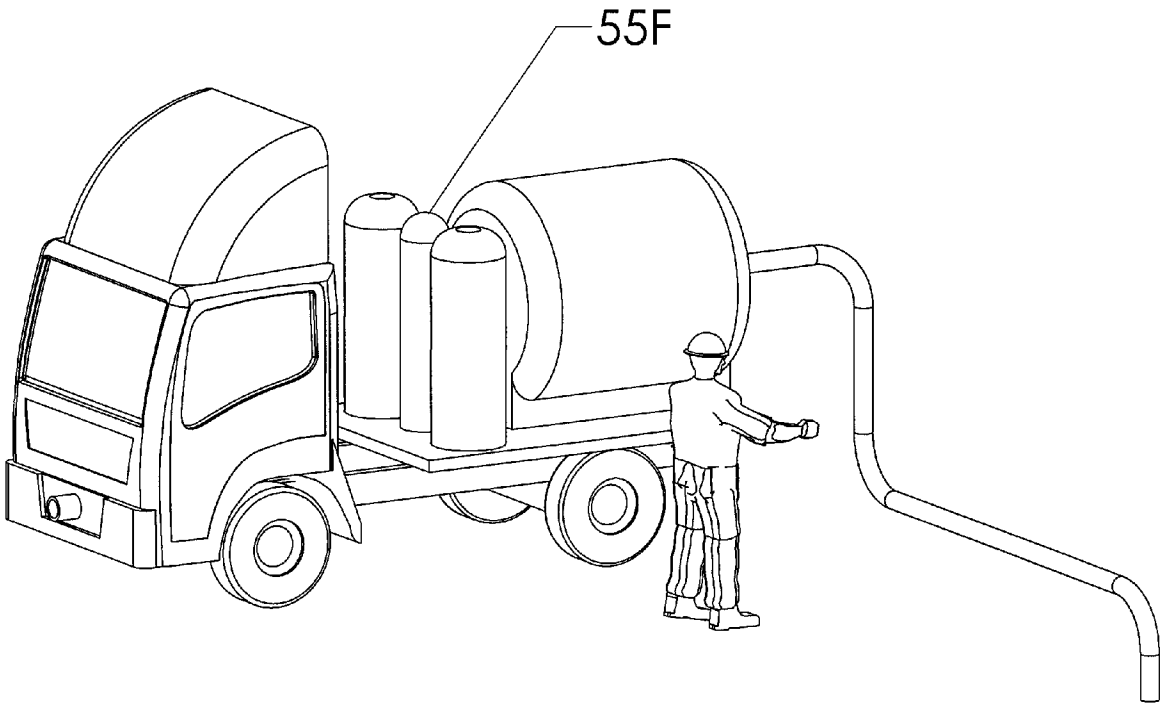
FIG. 10 is a side view of a truck used to vacuum up the residue and by products after a fire has been extinguished by the method of present invention.

Hose 32 can be connected to a supply of only water. In another embodiment, hose 32 can be connected to a pressurized supply of the admixture of super absorbent polymer and water. In this alternative embodiment, there is no need for container 34 or hose 36. The pressurized admixture of super absorbent polymer and water supplied to hose 32 can come from a vehicle, such as a utility van 58 (FIG. 4). Utility vans 58 are commonly employed by electric utility companies for servicing the utilities. A hose 50 is secured to the van 58. The admixture of super absorbent polymer and water is delivered from van 58 through hose 50 to hose 32 and into gun 37. The preferred location of the hose 50 on the van 58 is at the front bumper, as illustrated in FIG. 5. However, the hose 50 could be secured to van 58 at any location on the van. When the gun 37 is utilized in this alternative mode, the valve 33 regulates the amount of super absorbent polymer and water delivered to the fire. FIG. 9 illustrates a water tanker type of truck 59 which can be employed in place of van 58 in the present invention. The hose 50 can be secured to the tanker truck 59 at any location where there is a fluid outlet.

Figure 2:
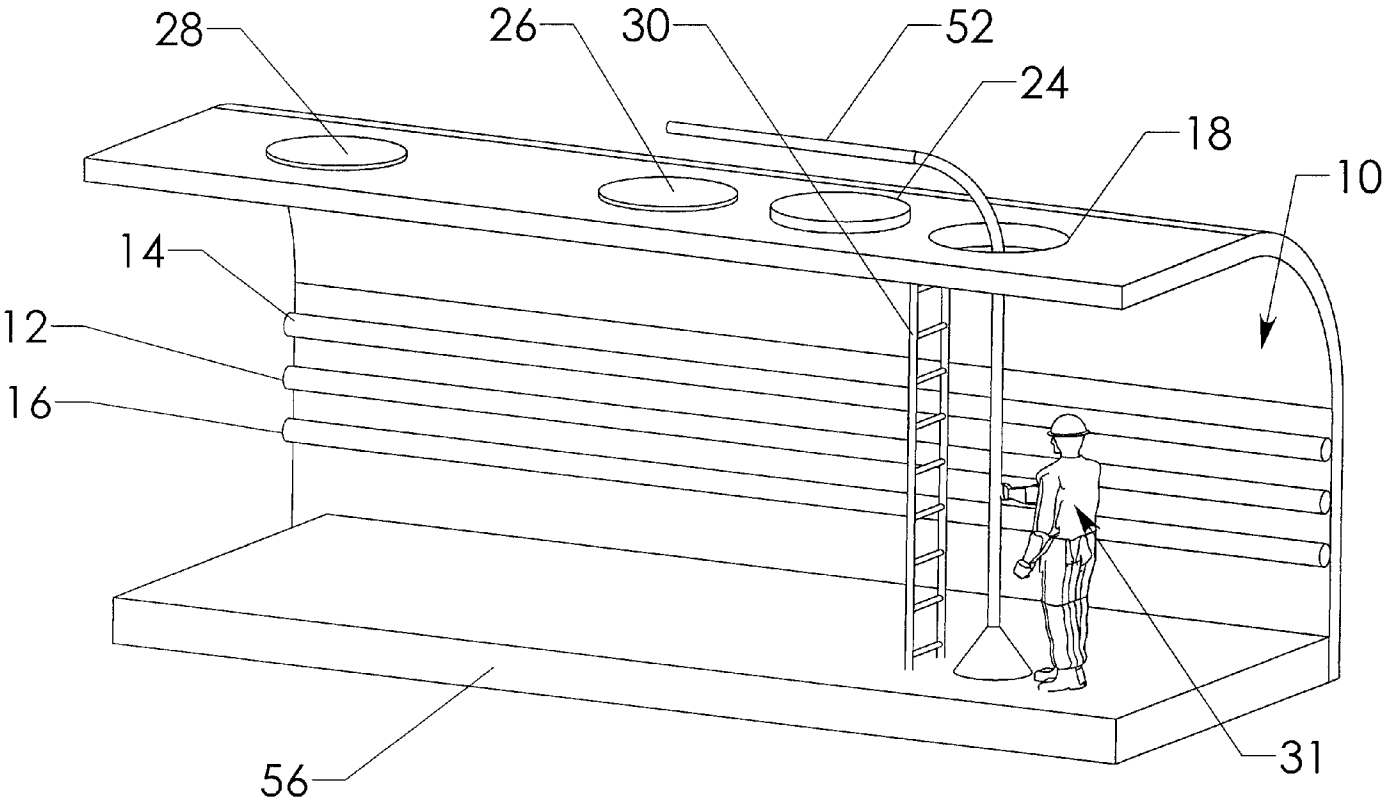
FIG. 2 is an illustration of a clean-up operation after an electrical fire has been extinguished by the present invention.
Figure 3:
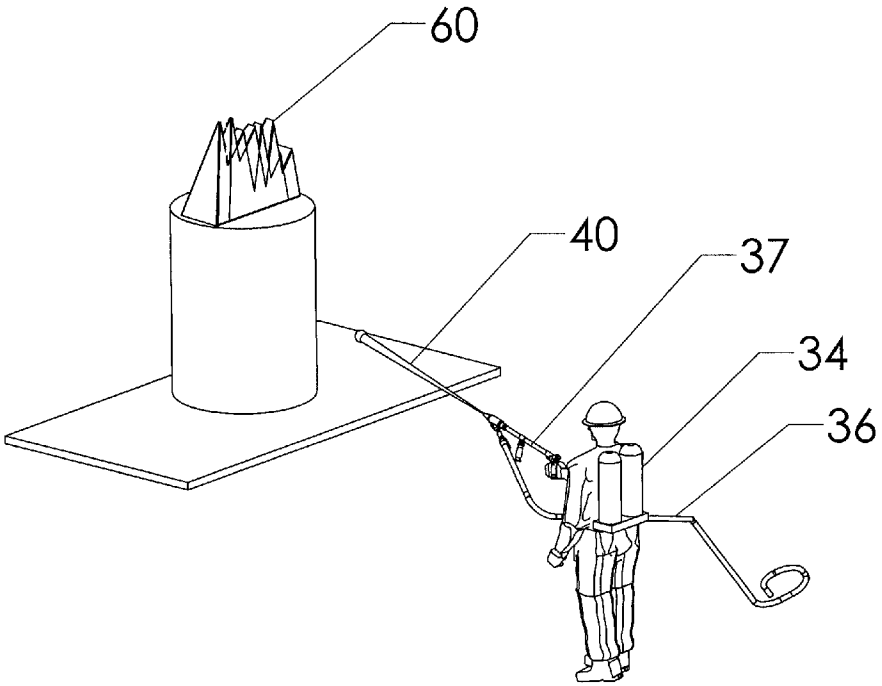
FIG. 3 is an illustration of the present invention being used to fight an electrical fire in an above ground location.

FIG. 2 illustrates a clean-up process after a fire has been extinguished. A vacuum hose 52 is connected to a source of vacuum. The source of vacuum is preferably on a truck 54 or similar vehicle, as illustrated in FIG. 12. The source of vacuum could be in a permanent location or a portable location, rather than on a truck. The vacuum hose 52 withdraws or sucks up the particulates 56 and other residue from the fire. This leaves the area in which the fire occurred relatively clean. Since the admixture of solid super absorbent polymer and water entraps the particulates and noxious and/or toxic gasses, the clean up is substantially easier and quicker than the clean up from other prior art methods of fire suppression and extinguishing. A test report of a plurality of tests performed by Kinectrics of the by-products and particulates remaining after the method of suppressing the spread of and extinguishing electrical fires of the present invention were employed follows (FireIce® is the trademark of the admixture of solid super absorbent polymer and water used in the method of the present invention):

Arc Performance & Byproducts of FireIce®

Summary of Air Sampling Results

1. Test Description

A total of five field test air sampling collections were undertaken on Jan. 18, 2011, at the High Current Laboratory (HCL) to evaluate the air emissions released from the application of FireIce® to artificial faults generated using copper and aluminum cables provided by GelTech Solutions. The five test scenarios were air sampled for airborne metals and organics. The description of the tests is given in Table 1.

TABLE 1

Test description

| Test # | Shot # | Test description | Cable description |
|---|---|---|---|
| 1 | 119 | New cables with copper conductor artificially faulted to create arc with no FireIce ® added. Target fault current: 2 kA. Fault duration: until fault self-extinguished. | coned 500 kcmil Cu 600 V EAM/LSNH installed in coned precast concrete distribution box type B-3.6 |
| 2 | 120 | New cables with copper conductor artificially faulted to create arc with FireIce ® added at the on-set of arc. Target fault current: 2 kA. Fault duration: until fault self-extinguished. | coned 500 kcmil Cu 600 V EAM/LSNH installed in coned precast concrete distribution box type B-3.6 |
| 3 | 121 | New cables with copper conductor artificially faulted to create arc with FireIce ® added at the on-set of arc - this was a repeat of test#2 due to poor arc generation and non propagation of arc. Target fault current: 2 kA. Fault duration: until fault self-extinguished. | coned 500 kcmil Cu 600 V EAM/LSNH installed in coned precast concrete distribution box type B-3.6 |
| 4 | 122 | New cables with aluminum conductor artificially faulted to create arc with FireIce ® added at the on-set of arc. | coned 350 MCM A1 600 V EPR installed in coned precast concrete distribution box type B-3.6 |
| 5 | 123 | New cables with aluminum conductor artificially faulted to create arc with "FireIce ®" added to concrete box to cover faulted cables prior to high current being applied to create arc. Target fault current: 2 kA. Fault duration: until fault self-extinguished. | coned 350 MCM A1 600 V EPR installed in coned precast concrete distribution box type B-3.6 |

In all the tests the cables were installed at the bottom of the concrete box, and the fault between the cables was created using a fuse wire. The approximate dimensions of the interior volume of the concrete box are: 33"×33"×24". The concrete box drawing is given in Appendix A. One calorimeter was installed above the concrete box to measure the incident energy generated by the fault. Pictures of the set-up are given in Appendix A (not attached).

Each test was recorded using a high speed video camera and a normal speed video camera. The current and the voltage waveforms are given in Appendix B (not attached). All the test data recorded (recorded waveforms, videos and photos) are provided in digital format on the DVD (not attached).

The sampling equipment consisted of five separate sampling trains, each with a sampling pump drawing air through various air sampling components using a calibrated mass flow controller to maintain constant flow. The sampling time for each train was two minutes during each of the 5 arc test scenarios. For each sampling train a flow rate was selected based on the type of air sample being collected. The five sampling trains consisted of the following components and the air flow rate utilized:

1. A sampling train consisting of a MCE (mixed cellulose ester) filter in a cartridge filter holder for aerosol collection generated during the arc. The air flow rate through the filter was set to 1 L/min.

2. A sampling train for organic compounds using two Carbotrap™ 300 sampling tubes in series (front-back arrangement) was placed with the front sampling tube inlet at the edge of the concrete bunker. The air flow rate for the organics sampling tube train was 0.050 L/min.

3. A sampling train consisting of three impingers in series with 1M nitric acid in the first two impingers and an empty third impinger was used to trap airborne metals. The metals train air flow rate was set to 0.50 L/min.

4. A sampling train identical to the one described in 3 but with 0.5M KOH added to the first two impingers and an empty third impinger was setup, plus an additional Carbotrap™ 300 organic compound sampling train as described in 2 was added in series to the outlet of the last impinger. The air sampling flow rate was set to 0.25 l/min for this train.

5. A final sampling train consisting of 3 impingers in series as described in 3 but with KOH added to the first two impingers and an empty third impinger to capture acidic species possibly generated during the Firelce® tests. The air sampling flow rate was set to 0.25 L/min for this train.

2. Organic Compound Sampling Results—Carbotrap™ 300 Tube Analyses 2.1 Post-Impinger Air Samples The organic compounds released to air were captured using Carbotrap™ 300 tubes after the air sample passed through a KOH impinger train. The sampling flow rate was 0.25 L/min. The total mass of organic compounds collected during each of the five arc fault tests are given in Table 2. The organic compounds identified in the air samples are summarized in Table 3.

TABLE 2

Total Mass of Organic Compounds Collected on Carbotrap ™ 300 Sample Tubes and Estimated FireIce ® Inhibition Ratio for Organic Compound Release

| [a] Test Number & Description | Total Mass of Organics Collected on Carbotrap ™ 300 Tubes (ng) | Minimum Removal Efficiency Compared to Test 1 |
|---|---|---|
| 1 Pair of New Neoprene Copper Cables - No FireIce ® Applied | 615 | — |
| 2 Pair of New Neoprene Jacketed Copper Cables - FireIce ®-Added at On-Set of Arc | 189 | 3.2 |
| 3 Pair of New Neoprene Jacketed Copper Cables - FireIce ®-Added at On-Set of Arc (Repeat) | 138 | 4.5 |
| 4 Pair of New Neoprene Jacketed Aluminum Cables - FireIce ® Added at On-Set of Arc | No Organic Compounds Detected | >61.5* |
| 5 Pair of New Neoprene Jacketed Aluminum Cables -- FireIce ® Added Prior to Arc Generation | No Organic Compounds Detected | >61.5* |

Note:

•—Assumed minimum removal efficiency is assumed to be >61.5 as detection limit for any single organic compound is 10 ng.

TABLE 3

Organic Compounds identified in High Flow Samples

| Test Number & Description | Organic Compounds Collected on Carbotrap ™ 300 Tubes Passage Through KOH Impingers | Total Organic Compound Mass (Front + Back) (ng) |
|---|---|---|
| 1 Pair of New Neoprene Copper Cables - No FireIce ® Added | ethane-1-chloro-1,1 difluoro* | 48000* |
| | 2-butene, 2-methyl | 18 |
| | 1,3-butadiene, 2-methyl | 40 |
| | 1,3 pentadiene | 35 |
| | 1,4 pentadiene | 14 |
| | cyclopentane | 23 |
| | 1-pentene, 2-methyl | 36 |
| | benzene | 62 |

TABLE 3-continued

| Organic Compounds identified in High Flow Samples | | |
|---|---|---|
| Test Number & Description | Organic Compounds Collected on Carbotrap ™ 300 Tubes Passage Through KOH Impingers | Total Organic Compound Mass (Front + Back) (ng) |
| | 1,4-cyclohexadiene | 25 |
| | 3-hexen-1-ol | 28 |
| | toluene | 237 |
| | ethylbenzene | 48 |
| | styrene** | 2740** |
| | α-methyl styrene** | 53** |
| 2 Pair of New Neoprene Jacketed Copper Cables - FireIce ®-Added at On-Set of Arc | ethane-1-chloro-1,1-difluoro | 68* |
| | 1,3-butadiene | 14 |
| | 1-pentene, 2-methyl | 21 |
| | propane, 2-methyl-1-nitro | 31 |
| | 3-heptene | 8 |
| | benzene | 62 |
| | butane, I-chloro-2-methyl | 25 |
| | styrene** | 99** |
| | unknown | 28 |
| 3 Pair of New Neoprene Jacketed Copper Cables - FireIce ®-Added at On-Set of Arc (Repeat) | ethane-1-chloro-1,1-difluoro | 264* |
| | 1-propene, 2-methyl | 16 |
| | 1,3-butadiene | 40 |
| | 2-butene, 2-methyl | 12 |
| | 1-pentene, 2-methyl | 25 |
| | benzene | 34 |
| | unknown | 11 |
| 4 Pair of New Neoprene Jacketed Aluminum Cables - FireIce ® Added at On-Set of Arc | No organic compounds detected on both front and back Carbotrap ™ 300 tubes | 0 |
| 5 Pair of New Neoprene Jacketed Aluminum Cables - FireIce ® Added Prior to Arc Generation | No organic compounds identified on both front and Carbotrap ™ 300 tubes | 0 |

Notes:

*The ethane-1-chloro-1,1-difluoro is suspected to be contamination resulting from the partial decomposition of impinger train holder used during testing. The Freon HCFC 142b released during tests 1 to 3 is the trapped blowing agent used to make the closed cell foam. The foam was used to support and secure the impinger trains. Not included in organic compound mass reported.

**The styrene and a-methyl styrene are unintentional contaminants generated from the destruction of the aerosol filter holder used during the first arc fault Test-1. The filter holder was too close to the arc-fault zone and did not survive Test-1. The styrene values are not included in organic compound mass reported.

2.2 Direct Air Sampling

The total mass of organic compounds in the air samples collected directly on to Carbotrap™ 300 tubes during each of the five arc fault tests are give in Table 4. The organic compounds captured with the Carbotrap™ 300 tubes and subsequently detected during analysis are listed in Table 5. The sampling flow rate was 0.05 L/min.

The total organic compound concentration measured directly with the Carbotrap™ 300 tubes associated with the copper cable arc fault in Test-1 is estimated to be 1.6 mg/m3 without the application of FireIce®. For Test-2 through Test-5 the organic compound concentrations are estimated to be 0.6 mg/m3, 0.15 mg/m3, 0.0 mg/m3 and 0.1 mg/m3, respectively.

TABLE 4

| Total Mass of Organic Compounds on Direct Air Sample onto Carbotrap ™ 300 Tubes and FireIce ® Inhibition Ratio | | |
|---|---|---|
| Test Number & Description | Total Mass of Organics Collected on. Carbotrap ™ 300 Tubes (Front + Back) (ng) | Minimum Removal Efficiency Compared to Test 1 |
| 1 Pair of New Neoprene Jacketed Copper Cables - No FireIce ® | 158 | — |
| 2 Pair of New Neoprene Jacketed Copper Cables - FireIce ®-Added at On-Set of Arc | 65 | 2.4 |
| 3 Pair of New Neoprene Jacketed Copper Cables - FireIce ®-Added at On-Set of Arc (Repeat) | 15 | >10 |
| 4 Pair of New Neoprene Jacketed Aluminum Cables - FireIce ® Added at On-Set of Arc | None Detected | >15.8 |
| 5 Pair of New Neoprene Jacketed Aluminum Cables - FireIce ® Added Prior to Arc Generation | 10 | 15.8 |

The FireIce® application appears to be effective in reducing organic emissions for both the copper cables and the aluminum cables. The removal efficiencies estimated in Table 2 and Table 4 compare well. The application of FireIce® reduces organic emissions when applied with the arc fault is active. The presence of external contamination confirms the effective organic sampling in the vicinity of the arc fault during the five tests.

TABLE 5

Organic Compounds Identified in Direct Air Samples Collected on Carbotrap ™ 300 Tubes

| | Test Number &Description | Organic Compounds Collected on Carbotrap ™ 300 Tubes | Organic Compound Mass (ng/tube) |
|---|---|---|---|
| 1 | Pair of New Neoprene Copper Cables - No FireIce ® Added | Ethane-1-chloro-1,1 difluoro* | 53* |
| | | 1-pentene, 2-methyl | 15 |
| | | benzene | 64 |
| | | toluene | 41 |
| | | styrene** | 70* |
| | | α-methyl styrene** | 217* |
| | | isobutyl nitrile | 11 |
| | | propane, 2-methyl-1-nitro | 14 |
| | | unknown | 13 |
| 2 | Pair of New Neoprene Jacketed Copper Cables - FireIce ®-Added at On-Set of Arc | 1-propene, 2-methyl | 8 |
| | | 1,3 butadiene | 16 |
| | | 2-butene, 2-methyl | 8 |
| | | 1-pentene, 2-methyl | 23 |
| | | unknown | 10 |
| 3 | Pair of New Neoprene Jacketed Copper Cables - FireIce ®-Added at On-Set of Arc (Repeat) | 1-pentene, 2-methyl | 15 |
| 4 | Pair of New Neoprene Jacketed Aluminum Cables - FireIce ® Added at On-Set of Arc | No organic compounds detected on both front and back Carbotrap ™ 300 tubes | 0 |
| 5 | Pair of New Neoprene Jacketed Aluminum Cables - FireIce ® Added Prior to Arc Generation | No organic compounds identified on both front and back Carbotrap ™ 300 tubes | 0 |
| | | Unknown peak (Front tube only) | 10 |

Notes:

*The ethane-1-chloro-1,1-difluoro is suspected to be contamination resulting from the partial decomposition of impinger train holder used during testing. The Freon HCFC 142b released during testing is the trapped blowing agent used to make the closed cell foam. The foam was used to support and secure the impinger trains. The Freon was not included in organic compound mass reported.

**The styrene and a-methyl styrene are unintentional contaminants generated from the destruction of the aerosol filter holder used during the first arc fault Test-1. The filter holder was too close to the arc-fault zone and did not survive Test-1. The styrene values are not included in organic compound mass reported.

TABLE 6

Metals Analysis Results (PPM) Filter Pack Sampling ~2 m Above Are Fault

| Metal | Blank (Avg) | Test 2 (Cu) | Test 3 (Cu) | Test 4 (Al) | Test 5 (Al) |
|---|---|---|---|---|---|
| Al | <0.5 | 3.15 | 6.81 | 1.48 | <0.5 |
| Ca | 2.15 | 1.80 | 4.96 | 2.52 | 1.93 |
| Cu | <1.5 | 94.8 | 312 | 1.98 | <1.5 |
| Fe | <0.25 | <0.25 | 2.85 | <0.25 | <0.25 |
| K | 67 | 68 | 39 | 28 | 23 |
| Mg | 0.19 | 8.4 | 18.9 | 0.25 | <0.1 |
| Na | <2.5 | <2.5 | 5.8 | <2.5 | <2.5 |
| P | <1 | <1 | 1.2 | <1 | <1 |
| S | <1 | <1 | 3.7 | <1 | <1 |
| Si | <1 | 4.3 | 20.5 | <1 | <1 |
| Ag | <0.005 | <0.005 | 0.007 | <0.005 | <0.005 |
| As | <0.05 | <0.05 | <0.05 | <0.05 | 0.05 |
| B | <0.05 | <0.05 | <0.05 | <0.05 | 0.05 |
| Ba | 0.007 | 0.012 | 0.022 | 0.008 | 0.006 |
| Bi | <0.005 | <0.005 | <0.005 | <0.005 | 0.005 |
| Be | <0.005 | <0.005 | 0.005 | <0.005 | <0.005 |
| Cd | <0.005 | <0.005 | <0.005 | 0.005 | <0.005 |
| Co | <0.005 | <0.005 | <0.005 | <0.005 | 0.005 |

TABLE 6-continued

Metals Analysis Results (PPM) Filter Pack Sampling ~2 m Above Are Fault

| Metal | Blank (Avg) | Test 2 (Cu) | Test 3 (Cu) | Test 4 (Al) | Test 5 (Al) |
|---|---|---|---|---|---|
| Cr | <0.005 | <0.005 | <0.005 | <0.005 | <0.005 |
| Cs | <0.005 | <0.005 | <0.005 | <0.005 | <0.005 |

TABLE 6-continued

Metals Analysis Results (PPM) Filter Pack Sampling ~2 m Above Are Fault

| Metal | Blank (Avg) | Test 2 (Cu) | Test 3 (Cu) | Test 4 (Al) | Test 5 (Al) |
|---|---|---|---|---|---|
| Li | <0.005 | <0.005 | 0.013 | <0.005 | <0.005 |
| Mn | 0.005 | 0.006 | 0.053 | 0.007 | 0.006 |
| Mo | <0.005 | <0.005 | <0.005 | 0.005 | <0.005 |
| Ni | 0.010 | 0.013 | 0.024 | 0.016 | 0.011 |
| Pb | <0.005 | 1.93 | 4.79 | 0.063 | 0.015 |
| Sb | 0.003 | 2.17 | 5.19 | 0.072 | 0.017 |
| Se | <0.05 | <0.05 | <0.05 | <0.05 | <0.05 |
| Sn | 0.029 | 0.036 | 0.028 | 0.006 | 0.005 |
| Sr | 0.007 | 0.006 | 0.028 | 0.009 | 0.006 |
| Th | <0.005 | <0.005 | <0.005 | <0.005 | <0.005 |
| Ti | 0.151 | 0.122 | 0.309 | 0.007 | 0.007 |
| Th | <0.005 | <0.005 | <0.005 | <0.005 | <0.005 |
| W | <0.005 | <0.005 | <0:005 | <0.005 | <0.005 |
| Zr | <0.005 | <0.005 | <0.005 | <0.005 | 0.005 |
| V | <0.05 | <0.05 | <0.05 | <0.05 | <0.05 |
| Zn | 0.037 | 1.22 | 3.02 | 0.054 | 0.042 |

TABLE 6-continued

| Metals Analysis Results (PPM) Filter Pack Sampling ~2 m Above Are Fault | | | | | |
|---|---|---|---|---|---|
| Metal | Blank (Avg) | Test 2 (Cu) | Test 3 (Cu) | Test 4 (Al) | Test 5 (Al) |
| Hg | <0.005 | <0.005 | <0.005 | <0.005 | <0.005 |
| U | <0.005 | <0.005 | <0.005 | <0.005 | <0.005 |

TABLE 7

| Metals Analysis Results (PPM) from Acid Impinger Sampler Train | | | | | | |
|---|---|---|---|---|---|---|
| Metal | MDL | Test 1 (Cu) | Test 2 (Cu) | Test 3 (Cu) | Test 4 (Al) | Test 5 (Al) |
| Al | <0.01 | 0.145 | 0.272 | 0.330 | 0.328 | 0.640 |
| Ca | <0.01 | 0.485 | 1.30 | 0.388 | 0.523 | 0.094 |
| Cu | <0.01 | 0.22 | 0.918 | 0.816 | 0.66 | 0.062 |
| Fe | <0.005 | 0.02 | 0.056 | 0.023 | 0.028 | 0.025 |
| K | <0.01 | 1.24 | 0.896 | 0.644 | 77.8 | 13000 |
| Mg | <0.002 | 0.042 | 0.134 | 0.056 | 0.318 | 0.012 |
| Na | <0.05 | 0.951 | 0.727 | 1.78 | 0.905 | 10.5 |
| P | <0.02 | <0.02 | 0.049 | 0.02 | <0.02 | <0.02 |
| S | <0.05 | 0.043 | 0.070 | 0.099 | 0.043 | 0.504 |
| Si | 0.1 | 0.303 | 0.48 | 1.10 | 0.49 | 21.4 |
| Ag | <0.0001 | 0.004 | 0.005 | 0.004 | 0.005 | 0.002 |
| As | 0.001 | 0.001 | <0.001 | <0.001 | <0.001 | <0.001 |
| B | 0.025 | 0.853 | 0.638 | 1.61 | 0.922 | 2.88 |
| Ba | 0.0001 | 0.006 | 0.008 | 0.007 | 0.006 | 0.002 |
| Bi | <0.001 | <0.001 | <0.001 | 0.001 | <0.001 | <0.001 |
| Be | <0.001 | <0.001 | <0.001 | <0.001 | <0.001 | <0.001 |
| Cd | <0.0001 | <0.0001 | <0.0001 | <0.0001 | 0.0002 | <0.0001 |
| Co | <0.0001 | 0.0001 | 0.0004 | <0.0001 | 0.0002 | 0.0001 |
| Cr | 0.0001 | 0.0007 | 0.0009 | 0.0006 | 0.0006 | 0.019 |
| Cs | <0.0001 | <0.0001 | 0.0001 | <0.0001 | 0.002 | 0.819 |
| Li | <0.001 | <0.001 | 0.001 | 0.001 | <0.001 | 0.004 |
| Mn | <0.0001 | 0.001 | 0.002 | 0.0006 | 0.0010 | 0.015 |
| Mo | <0.0001 | 0.0002 | 0.0002 | 0.0003 | 0.0002 | 0.0020 |
| Ni | 0.0001 | 0.002 | 0.001 | 0.002 | 0.002 | 0.001 |
| Pb | 0.0001 | 0.003 | 0.003 | 0.008 | 0.009 | 0.008 |
| Sb | <0.001 | 0.002 | 0.002 | 0.007 | 0.003 | <0.001 |
| Se | 0.001 | <0.001 | <0.001 | <0.001 | <0.001 | 0.004 |
| Sn | 0.0001 | 0.0004 | 0.0003 | 0.0002 | 0.0005 | 0.0020 |
| Sr | <0.0001 | 0.002 | 0.005 | 0.002 | 0.003 | 0.001 |
| Th | <0.0001 | <0.0001 | <0.0001 | <0.0001 | <0.0001 | <0.0001 |
| Ti | 0.0001 | 0.001 | 0.004 | 0.002 | 0.002 | 0.014 |
| Tl | 0.0001 | <0.0001 | 0.0001 | <0.0001 | <0.0001 | <0.0001 |
| W | <0.0001 | <0.0001 | 0.0001 | <0.0001 | 0.0001 | 0.037 |
| Zr | <0.0001 | 0.0002 | 0.0008 | 0.0007 | 0.0007 | 0.027 |
| V | <0.0001 | 0.0001 | <0.0001 | <0.0001 | <0.0001 | 0.0002 |
| Zn | 0.0001 | 0.01 | 0.009 | 0.01 | 0.021 | 0.003 |
| Hg | <0.0001 | <0.0001 | <0.0001 | <0.0001 | <0.0001 | <0.0001 |
| U | <0.0001 | <0.0001 | <0.0001 | <0.0001 | <0.0001 | <0.0001 |

A 2-liter air sample was taken through a filter pack at about 2 meters above each arc test. Each available exposed filter was analyzed for metals and other elements. The results for 38 element analyses are presented in Table 6. As a note, the filter pack used during Test 1 was destroyed by the extreme heat generated by the copper cable arc as the filter was too close to the arc.

Some key observations are noted from filter analysis for the Test 2 through Test 5 data available in Table 6:

A key result noted is the below detection of aluminum for Test 5 compared to a measurable detection in Test 4. Both tests used new aluminum cables for the arc fault, but in the Test 5 case the fault zone was encapsulated in FireIce® prior to arc fault generation whereas for Test 4 the arc fault was initiated into air and then FireIce® was added to quench the arc fault. The lead (Pb), antimony (Sb), magnesium (Mg), copper (Cu) and calcium (Ca) results add confirmation to the reduction of released metals with the arc fault encapsulated.

The counter ion for FireIce® is potassium (K). For all four arc fault tests, the filter analysis did not detect potassium above the nominal background concentration of potassium present on the filter prior to exposure. This is good evidence that FireIce® did not undergo detectable degradation during the arc faults where FireIce® was applied.

Test 2 and Test 3 were essentially duplicate tests using new neoprene jacketed copper cables for the arc fault with Test 3 having the more sustained arc fault. The procedure for applying FireIce® was the same for both tests. At the on-set of the arc fault the addition of FireIce® was begun and continued until the concrete cell was about ½ full. For the more sustained arc fault (Test 3) the key metals from the vaporized copper cable as measured with the filter pack were about 3 to 4 times higher than the metals released in the much shorter arc period of Test-2. Key metals released were aluminum (1.7%), copper (80%), magnesium (4.8%), zinc (0.8%), lead (1.2%), calcium (1.3%) and antimony (1.3%) with remaining components at <1% to only present at trace levels.

The estimated airborne total metals concentration for Test 3 is 0.17 $g/m^3$ and for Test 2 is 0.058 $g/m^3$. Similarly for the aluminum cables the estimated airborne total metals concentration for Test-4 is 0.003 $g/m^3$ and for Test-5 is 0.001 $g/m^3$.

For comparison the Ontario Ministry of Labor time-weighted average exposure concentration (TWAEC) for a variety of fumes and particulate, ranges from 0.003 to 0.01 $g/m^3$ for 40-hr work week and for short term exposures, the particulate concentrations range from 0.005 to 0.02 $g/m^3$ for a maximum 15 minute continuous exposure depending on the fume and particulate present.

Observations from the metals train analysis for Tests 1 through 5 are summarized below and are based on the metal/element analysis data present in Table 7.

The high level of potassium in the Test 5 results were from the entrainment of airborne FireIce® into the first impinger as the arc generated gas that ejected some of the FireIce® material into the air. This is confirmed by the increase in silica, sodium and sulfur.

For Test 4 a significant level of copper (0.66 ppm) is measured as copper residue from tests 1 to 3 is released during the aluminum cable arc fault. However, in Test 5, very little copper is detected (>10× less detected 0.062 ppm) with the FireIce® encapsulating the arc fault zone. This also confirmed by the similar reduction in magnesium detected.

The impinger samples collected similar amounts of metals for the copper cable arc fault tests. The metal concentration levels were and are given in Table 7.

3. Summary

The application of FireIce® to neoprene jacketed copper and aluminum cables is effective in reducing airborne organic compounds and also airborne metals. Removal efficiencies from 2 times to greater than 15 times can be expected when added to an active arc fault. For a FireIce® encapsulated arc fault greater than 60 times removal of metals and arc generated arc products is possible based on the five tests performed.

FIG. 4 is an example of how an above ground fire 60 is extinguished and the spread of the fire suppressed by the method and apparatus of the present invention. The admixture of solid super absorbent of polymer and water 40 can be applied to the fire 60 by use of the gun or wand 37 as described above in the embodiment illustrated in FIG. 1.

While the polymeric material is admixed with the fluid, it should be noted that the pressurized water allows for an enhanced incorporation of water into the polymeric material for instant distribution. However, it should also be noted that a structure or building that is susceptible to fire is most likely in an extremely dry state and it has been found beneficial to first moisten the structure with water and then apply a coating of composition of polymeric material and water. In this application method, the mixture retains moisture for a longer period as the structure does not immediately draw upon the mixture to obtain a balance of moisture. The water application can be performed by use of the gun or wand 37 with the second valve 41 rotated into an off position. Once the structure is moistened with water, the eductor control valve can then be opened wherein the mixture is applied to the structure. The polymeric material acts a partial shield to the structure wherein the structure moisture is held for a longer period of time, as compared to a moistened structure that is not coated. In addition, the mixture provides a ready source of moisture to maintain the structure moisture thereby enhancing the fire inhibiting properties of water.

The nozzle 39 may also be adjusted or changed to provide a stream or spray that is most suitable for the application at hand. A stream might be used for hard areas such as a two story home or a tall tree. A spray would be more suitable for coating a vertical wall with minimal passage. It should be emphasized that one of the advantages of the present invention is that the operator need not climb upon the roof in order to reach an area that requires application. In addition, an adjustable spray nozzle is of assistance to accommodate the pressure of the incoming water. In some parts of California it is not uncommon to have municipal water pressure that exceeds 80 psi. In other instances the incoming pressure may be zero, such as when the incoming water is drawn from a swimming pool. When municipal water is applied the flow rate may be higher than normal than water drawn from a swimming pool having no pressure wherein the pressure would be lower than normal.

The present invention can also be modified or adapted to fight forest fires and/or brush fires. In these situations the admixture of super absorbent polymer and water will remain on trees and vegetation much longer that just water. This will help extinguish the fire and also suppress the spread of the fire. Utilization of this type of fire fighting composition can eliminate the timely and costly need for "fire breaks" to stop the spread of the fire. It is substantially fasted to spray an admixture of super absorbent polymer and water onto an area to establish a "fire break" that it is to physically remove the tress, brush, and vegetation.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A system for enhancing the fire suppression and extinguishing properties of water comprising:

a wand, said wand having an eductor secured to one end thereof;

a nozzle secured to an outlet of said eductor;

a hose secured to another end of said wand, said hose supplying pressurized water to said wand;

a first valve, said first valve regulating an amount of pressurized water supplied to said wand;

a second valve fluidly connected to said eductor, said second valve regulating an amount of super absorbent polymer supplied to said eductor from a backpack; and a vacuum hose, said vacuum hose fluidly connected to a source of vacuum;

whereby when pressurized water is passed through said eductor a regulated amount of super absorbent polymer is drawn into said eductor and mixed with said pressurized water to produce an admixture of water and super absorbent polymer, said admixture of water and super absorbent polymer having properties which enable said admixture of water and super absorbent polymer to adhere to surfaces thereby greatly enhancing the fire extinguishing and fire suppression properties of water alone wherein said vacuum hose is utilized to withdraw particulate material from a site of a fire after the fire has been extinguished.

2. The device of claim 1 wherein said first valve is an on-off valve which permits and prohibits the flow of pressurized water to said wand.

3. The device of claim 1 wherein said first valve is an adjustable valve which regulates the flow rate of pressurized water admitted to said wand.

4. The device of claim 1 wherein said second valve controls the amount of super absorbent polymer admitted to said gun to thereby produce admixtures of super absorbent polymer and water in varying proportions of super absorbent polymer and water.

5. The device of claim 1 wherein said super absorbent polymer is a dry solid.

6. A system for enhancing the fire suppression and extinguishing properties of water comprising:

a wand, said wand having an eductor secured to one end thereof;

a nozzle secured to an outlet of said eductor;

a hose secured to another end of said wand, said hose supplying pressurized fluid to said wand;

a first valve, said first valve regulating an amount of pressurized fluid supplied to said wand; and a vacuum hose, said vacuum hose fluidly connected to a source of vacuum;

whereby said pressurized fluid has properties which enable said pressurized fluid to adhere to surfaces thereby greatly enhancing the fire extinguishing and fire suppression properties of water alone wherein said vacuum hose is utilized to withdraw particulate material from a site of a fire after the fire has been extinguished.

7. The system of claim 6 wherein said pressurized fluid is an admixture of super absorbent polymer and water.

8. The system of claim 7 wherein said pressurized fluid is contained in a truck and supplied to said wand from said truck.

* * * * *